US006465972B1

(12) United States Patent
Kachmarik et al.

(10) Patent No.: US 6,465,972 B1
(45) Date of Patent: Oct. 15, 2002

(54) ELECTRONIC ELIMINATION OF STRIATIONS IN LINEAR LAMPS

(75) Inventors: David J. Kachmarik, Strongsville; Louis R. Nerone, Brecksville, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/874,588

(22) Filed: Jun. 5, 2001

(51) Int. Cl.[7] ..... H05B 37/02
(52) U.S. Cl. ..... 315/209 R; 315/224
(58) Field of Search ..... 315/224, 225, 315/209 R, DIG. 4, DIG. 5, DIG. 7, 291, 219, 244, 247, 246

(56) References Cited

U.S. PATENT DOCUMENTS 5,001,386 A 3/1991 Sullivan et al. ..... 315/219
5,150,014 A * 9/1992 Kastelein ..... 315/224
6,069,453 A * 5/2000 Arts et al. ..... 315/209 R

* cited by examiner

*Primary Examiner*—Don Wong
*Assistant Examiner*—Wilson Lee
(74) *Attorney, Agent, or Firm*—Fay, Sharpe, Fagan, Minnich & McKee, LLP

(57) ABSTRACT

The present invention provides a lighting system powered by a system power source. The lighting system includes a ballast in operative connection with the system power source where the ballast is designed to generate a lamp input signal. A lamp input line is operatively connected to receive the lamp input signal. Further, a gas discharge lamp is in operative connection to the lamp input line configured to receive the lamp input signal. An amplitude modulation circuit is then placed in operative connection to the lamp input line, where the amplitude modulation circuit is configured to periodically modulate amplitudes of the lamp input signal prior to the lamp input signal being received by the gas discharge lamp. Operation of the amplitude modulation circuit results in a periodic amplitude modulation of the lamp input signal and eliminating visual striations otherwise occurring in the lamp.

19 Claims, 4 Drawing Sheets

ELECTRONIC ELIMINATION OF STRIATIONS IN LINEAR LAMPS

BACKGROUND OF THE INVENTION

The present invention is directed to improving the visual appearance of linear fluorescent lamps, and more particularly, to the elimination of visual striations which may occur in gas discharge lamps. Generally, a gas discharge lamp will have an elongated gas-filled tube having electrodes at each end. A voltage between the electrode accelerates electrons movement. This causes the electrons to collide with gas atoms producing positive ions and additional electrons forming a gas plasma of positive and negative charge carriers. Electrons continue to stream toward the lamp's anode and the positive ions toward its cathode sustaining an electric discharge in the tube and further heating the electrodes. The electric discharge causes an emission of radiation having a wavelength dependent on the particular fill gas and the electrical parameters of the discharge.

A fluorescent lamp is a gas discharge lamp in which the inner surface of the tube is coated with a fluorescent phosphor. The phosphor is excited by the ultraviolet radiation from the electric discharge and fluoresces, providing visible light.

During operation of a gas discharge lamp, such as a fluorescent lamp, a phenomenon known as striations can occur. Striations are zones of light intensity, appearing as dark bands. This phenomenon can give a lamp an undesirable strobing effect. An example of the striation phenomenon is shown in FIG. 1, which depicts a linear fluorescent lamp 10 employing Krypton added as a buffer gas to improve the efficacy of the lamp. In FIG. 1, lamp 10 has striation zones 12 which appear as the dark bands moving along the length of the lamp. Striations in gas discharge lamps are known to occur in cold applications and in other contexts such as Krypton content lamps.

A variety of theories as to why striations occur have been set forth. For example, in U.S. Pat. No. 5,001,386 to Sullivan, it is stated that striations are believed to occur as a result of high-frequency currents re-enforcing a standing wave of varying charge distribution between the lamp electrodes.

Sullivan attempts to solve the striation problem by injecting a dc component superimposed on top of a driving ac current. A disadvantage to this technique, is the requirement that existing typical high-frequency ballasts in the marketplace must be removed and replaced with a unique ballast capable of injecting the dc bias component. Also, by adding the dc bias it is possible to cause damage to the lamp, by moving mercury in the lamp to one end, creating an unbalanced light output. It has also been suggested that increasing the crest factor in a lamp lighting system will eliminate the usual striations. However, increasing the crest factor may also increase the stress on a lamp, which will lead to a shorter lamp life.

Therefore, it would be beneficial to provide a retrofit or upgrade of existing units which does not require the replacement of typical high-frequency ballasts now in place.

BRIEF SUMMARY OF THE INVENTION

The present invention provides a lighting system powered by a system power source. The lighting system includes a ballast in operative connection with the system power source where the ballast is designed to generate a lamp input signal.

A lamp input line is operatively connected to receive the lamp input signal. Further, a gas discharge lamp is in operative connection to the lamp input line configured to receive the lamp input signal. An amplitude modulation circuit is then placed in operative connection to the lamp input line, where the amplitude modulation circuit is configured to periodically modulate amplitudes of the lamp input signal prior to the lamp input signal being received by the gas discharge lamp. Operation of the amplitude modulation circuit results in a periodic amplitude modulation of the lamp input signal and eliminating visual striations otherwise occurring in the lamp.

DETAILED DESCRIPTION OF THE PREFERRED EMBODIMENT

Figure 1:
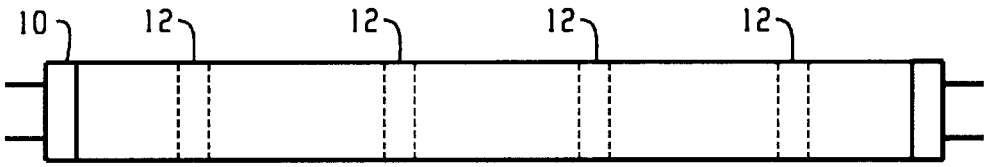
FIG. 1 illustrates a typical fluorescent lamp having striation zones creating a strobing effect to an end user.
Figure 2:
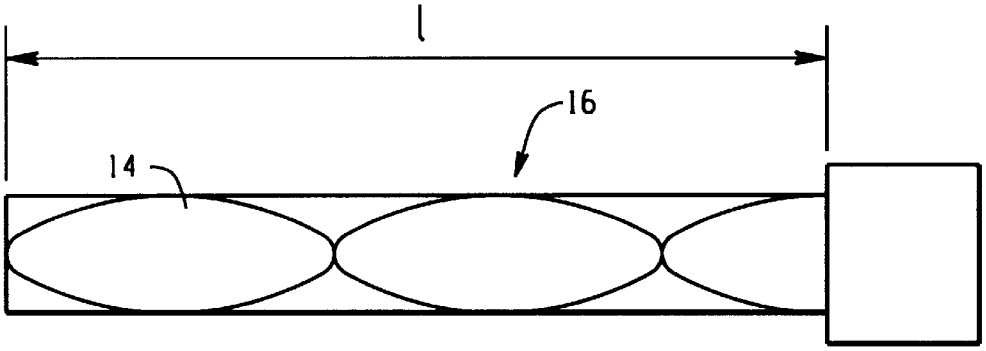
FIG. 2 illustrates a standing pressure wave in a closed organ pipe.

As depicted in FIG. 1, the striation zones 12 generate an undesirable visual effect to an end user. In addressing this problem, the inventors applied a null hypothesis to describe the striation phenomenon, and propose the physics behind striations can be modeled as a standing pressure wave 14 in an enclosed organ pipe 16, such as shown in FIG. 2. The frequency of resonance for a closed pipe is given by:

$$f_n = \frac{n}{4l}\sqrt{\frac{\frac{C_p}{C_v}P_0}{\rho_0}}$$

where 1 is length unit, n is harmonic, $c_p$ is molar capacity as constant volume, $c_v$ is molar capacity at constant pressure, $P_0$ is undisturbed gas pressure and $\rho_0$ is density of gas outside compression zone.

Using this hypothesis, the inventors developed a circuit which periodically modulates the input current to the lamp. By altering the modulation of the current in this periodic manner, the repetitive resonance frequencies which are believed to create the striations are interfered with thereby eliminating the visual appearance of striations.

Figure 3:
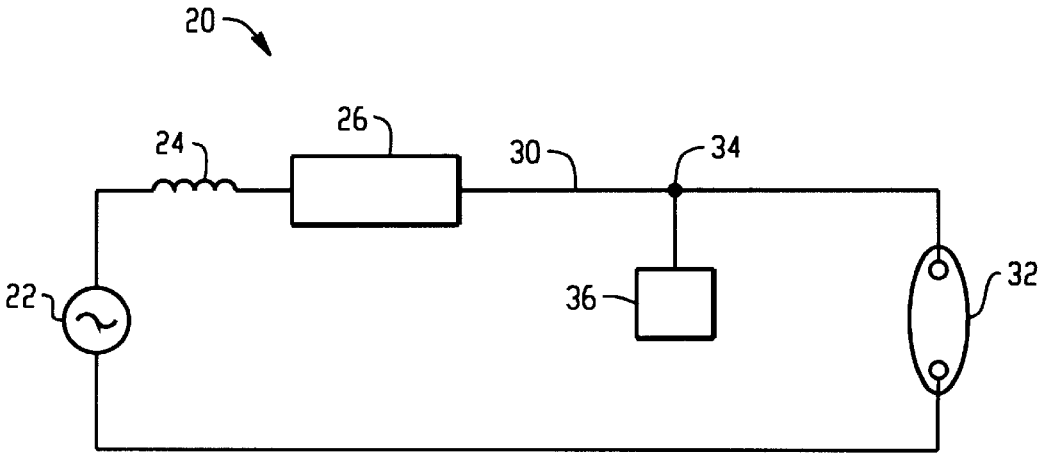
FIG. 3 depicts a high-level view of a system implementing the concepts of the present invention.

FIG. 3 sets forth an exemplary lamp lighting system 20 which incorporates the concepts of the present invention. An input power source 22 supplies power through an input filter 24 to a ballast 26. A lamp input line 30 supplies an input current signal from ballast 26 to lamp 32. Also connected to input line 30 at junction 34, is an amplitude modulation circuit 36 according to the present invention. Amplitude modulation circuit 36 alters the input current carried on input line 30 at periodic intervals by interjecting a periodic amplitude modulation signal. Operation of amplitude modulation circuit 36 results in an altering of at least portions of the input signal to modulate the input current.

Figure 4:
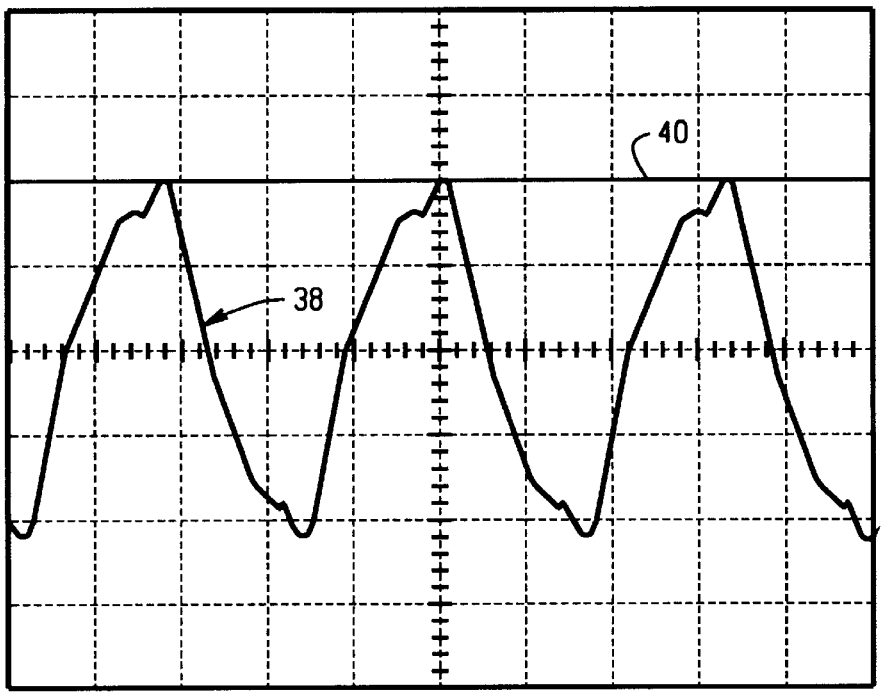
FIG. 4 illustrates a standard arc current forcing function or lamp input current.
Figure 5:
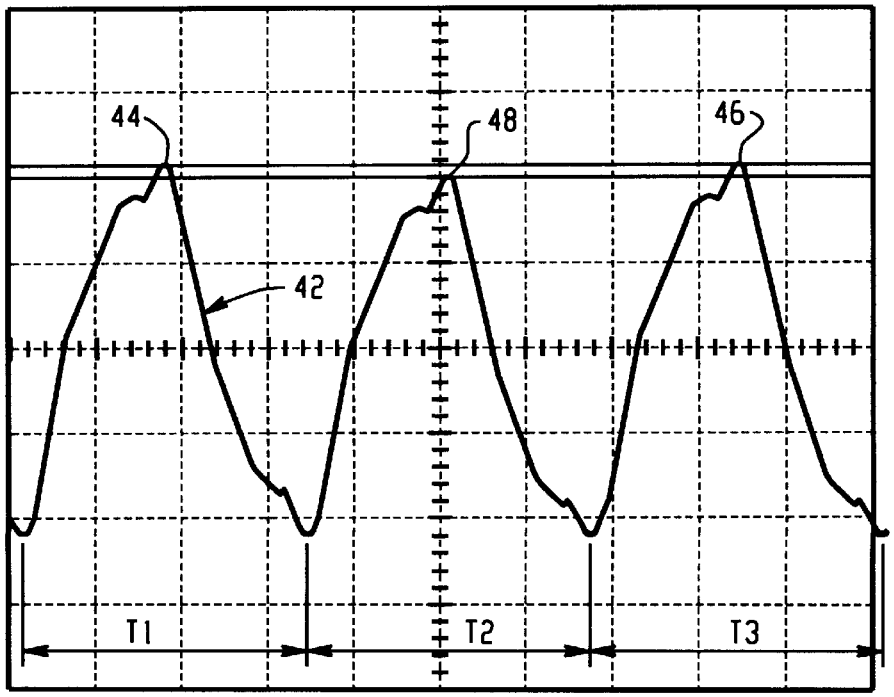
FIG. 5 depicts a lamp input current obtained by use of the concepts of the present invention.

To illustrate the results achieved by circuit 20, attention is directed to FIGS. 4 and 5 which show lamp input current signal for an Argon/Krypton fluorescent lamp. As may be seen in FIG. 4, shown is a lamp input current signal 38 in a conventional lighting system, not implementing the amplitude modulation circuit of the present invention.

As illustrated by line 40, the peaks of the input signal 38 are all substantially equal. Implementation of amplitude modulation circuit, and as shown in FIG. 5, permits the selective and periodic altering of the lamp input current signal 42, whereby the value of the input signal or portions of the input signal are modulated in a controlled manner. For example, as shown in FIG. 5, whereas peak 44 and peak 46 are substantially at equal values, the value of peak 48 has been modulated to a lower value. More specifically, in this embodiment, the values of 44 and 46 are approximately 214 mA, whereas the modulated value for peak 48 is approximately 200 mA. Therefore, there is a differential of substantially 14 mA. This differential is sufficient to remove the visual striations from an operating lamp, caused by the repeating resonance signals.

It is also to be noted that modulation is made to the value of the input lamp current, and not to its frequency. Particularly, the time periods T1, T2 and T3 in FIG. 5 are not altered from FIG. 4 or from each other.

Figure 6:
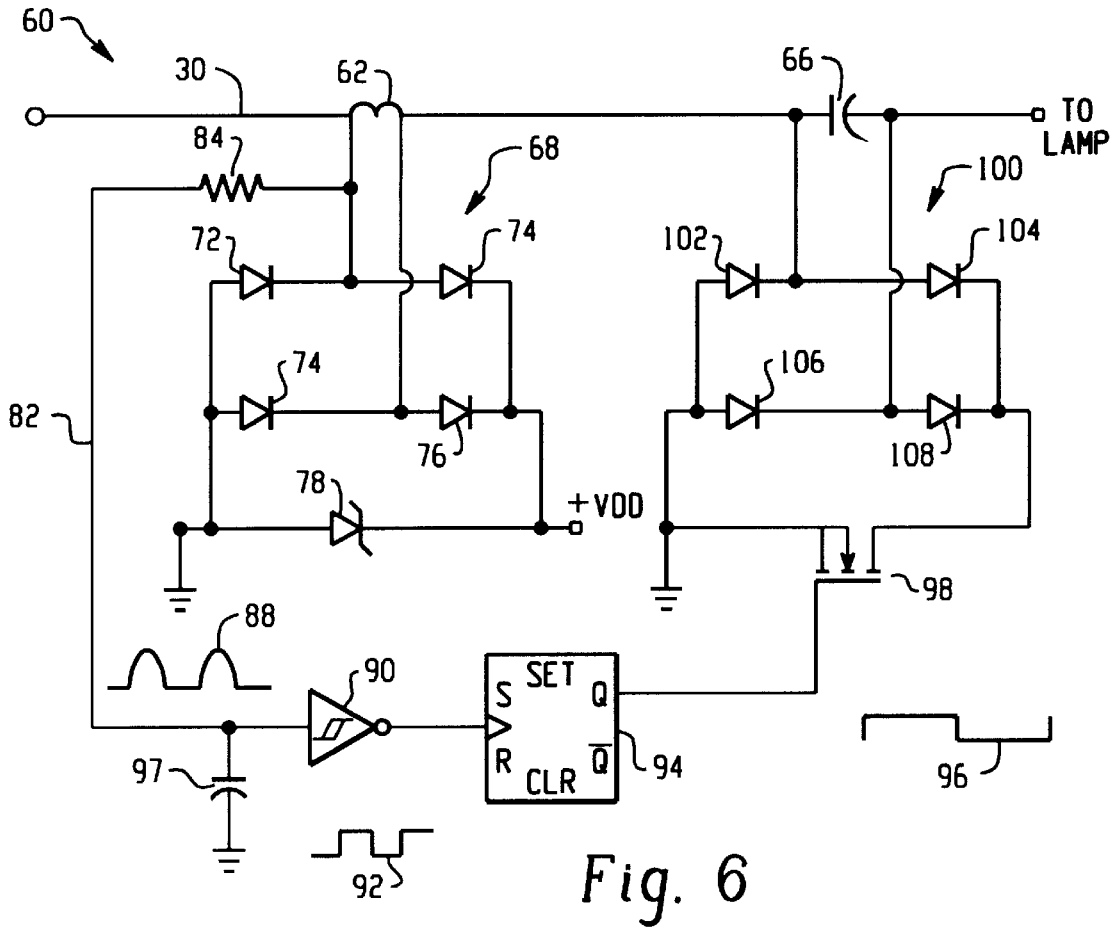
FIG. 6 sets forth a more detailed view of the amplitude modulation circuit of the present invention.

Turning to FIG. 6, shown is an embodiment of the amplitude modulation circuit 60 according to the present invention which may be implemented as a separate module attached to the lamp, or a circuit which may also be integrated into the lamp. Circuit 60 of FIG. 6 is placed in series with the lamp, by its connection to lamp input line 30, via a current transformer 62 and a capacitor 64. Current transformer 62, which in this embodiment is an inductor, but may be implemented in other known designs, is used to acquire energy from the input line 30 by acquiring at least a portion of the lamp input current carried on lamp input line 30. Although not shown in this figure but disclosed in previous figures, input line 30 receives a lamp input signal from ballast 26 (FIG. 3). The portion of current acquired by current transformer 62 is rectified by full bridge rectifier 68 including diodes 70–76. Zener diode 78 permits for the build-up of a voltage 80 (+VDD) which in one embodiment may be approximately 5 volts, sufficient to power logic electronics used in circuit 60. The design of circuit 60 meets the desired low power consumption requirements, and therefore the energy obtained via current transformer 62 is sufficient.

Signal line 82, which includes resistive element 84, carries a half-wave rectified signal 88, which is converted into a voltage and appears at the input of Schmidt trigger 90. The Schmidt trigger 90 generates a substantially digital output 92, which is then supplied to flip-flop 94. The flip-flop 94 is essentially a divide-by-two device whereby the output signal 96 becomes half the frequency of the input lamp current signal. Also shown in the circuit of FIG. 6 is common capacitor 97.

Output signal 96 is used to control the operation of transistor 98. Particularly, transistor 98, which acts as a switch, and full-bridge inverter 100, consisting of diodes 102–108, permit a selective bypassing of the capacitor in input line 30. Operation of transistor 98 acts as a switch which shorts this portion of the circuit every full cycle of the current input. Therefore, in operation either capacitor 64 will be in series with the lamp, or the switch, defined by transistor 98 and full-bridge rectifier 100 will be in series with the lamp.

By passing capacitor 64, causes the current input to the lamp to increase, whereas opening of switch 98 causes current to flow through capacitor 66 resulting in the input current being lowered.

It is to be appreciated the current level variation in this embodiment is very small. Particularly, this results in a decrease of approximately 14 mA out of a total of approximately 214 mA. By altering the amplitude, the present amplitude modulation circuit design disturbs the resonance occurring within the lamp.

The present design as shown for example in FIG. 3 and FIG. 6 does not increase the crest factor of the lamp system, and therefore does not increase the stress on the lamp. This system also does not introduce a dc bias which at certain levels is known to cause mercury within the lamp to migrate toward one end. This results in the lamp having bright spots on one end and dull spots on an opposite end. Also, the addition of the amplitude modulation circuit described in FIG. 6 will only decrease the efficiency of the lamp by approximately ½% or less.

In an alternative embodiment, the amplitude modulation circuit may be integrated into the ballast. In this design, it is not necessary to include the amplitude modulation power source defined by the diode bridge 68 and Zener diode 78 of FIG. 6. Particularly, power from the ballast circuit itself is used to power electronics 90 and 94 of FIG. 6. Therefore, when a circuit such as circuit 60 of FIG. 6 is integrated with a ballast, the current transformer 64 and signal line 82 may continue to provide the input to Schmidt trigger 90. Using this powering sequence, results in an efficient circuit whereby the decrease in efficiency of the overall lighting system is significantly less than ½%.

Further, while the present embodiment is shown implementing the switching techniques through the use of Schmidt trigger 90, along with voltage divider 94, other design alternatives are possible. For example, a digital timer may be used to control operation of the switch 98. Further, the switching network including switch 98 along with the full-bridge rectifier 100 may also be implemented in a variety of designs in order to obtain amplitude modulation of the input current. For example, in another embodiment, it may be appropriate to inject a signal within the system, thereby increasing the input line current rather than using capacitor 66 to decrease the input line current. It is to be understood that these designs are also considered by the inventors as being within the scope of the present invention. Further, all embodiments of the present invention may be implemented using other known electronic control devices which are capable of adjusting the amplitude of the input lamp current.

Figure 7:
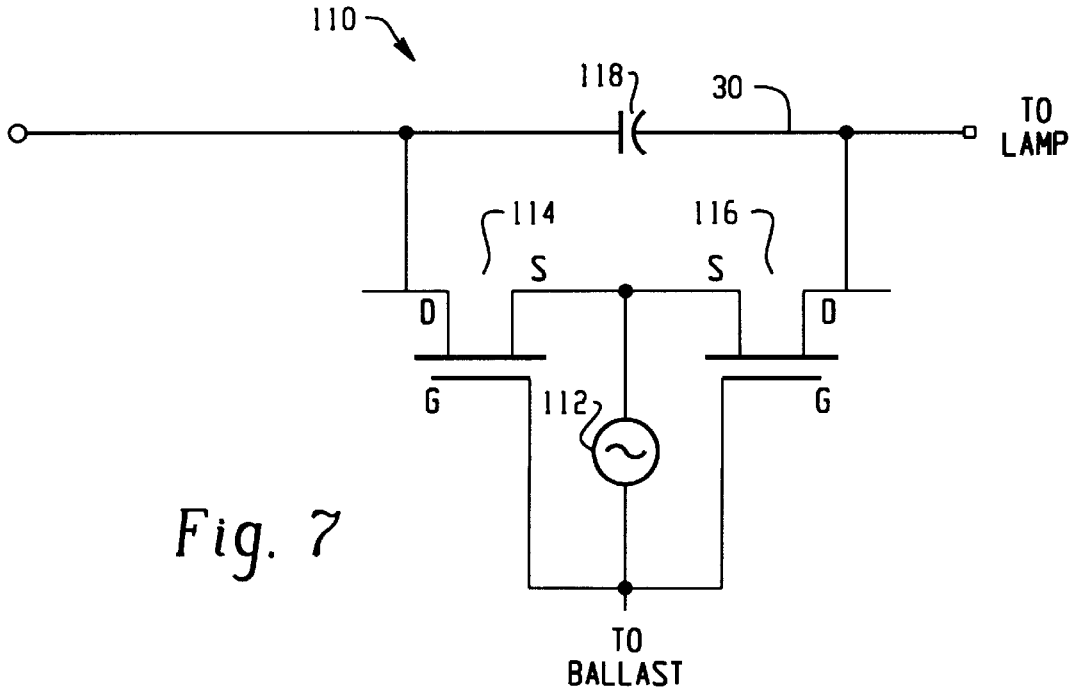
FIG. 7 depicts a further embodiment of an amplitude modulation circuit.

In this regard, and with attention to still another embodiment as shown in FIG. 7, when integrated into the ballast, amplitude modulation circuit 110 may be used. Particularly, as shown in FIG. 7, since this circuit is internal to the ballast, there is no need to generate separate power for the electronics. Rather, power 112 is supplied directly from the ballast. In this embodiment, in place of using switch 98 with full-bridge rectifier 100, a pair of switching transistors, such as MOSFETS or other appropriate transistor, 114 and 116 are used.

In this design a signal is periodically applied between the connected gates and sources, with the drains placed in parallel with capacitor 118 across input line 30. When both transistors 114 and 116 are in an "on" state, they act as resistors with very small resistances, dependent upon their RDS values. In this state, the input lamp current bypasses capacitor 118. When the transistors are "off", they act as a blocking mechanism forcing the lamp input current to pass through capacitor 118. Since transistors 114 and 116 are tied together, when the voltage across the gates are at zero, and they are n-channel devices, intrinsic diodes act to block any current flow, resulting in the arrangement to be equivalent to an open switch.

The gates may be turned "on", for example, by applying 5 volts between the gates and source. At this point, again, the transistors act as resistors having small values, thereby shorting out the capacitor 118. By making the resistances of the n-channel devices low enough, the voltage drop across the channels of transistors 114 and 116 will not be high enough to turn on the intrinsic diodes resulting in transistors 114 and 116 acting simply as resistive elements. Therefore, if for example, there was 200 mA flowing in the circuit, and 2 ohm transistors are used, then there would be only 0.4 volts drop across each transistor. This results in a very low voltage system. If the current or resistance of the transistors is higher such that the intrinsic diodes are turned on, then the voltage of the system would include the diode voltage drops plus the RDS of transistors 114 and 116.

An aspect of the present invention is to solve the striation problem without unnecessarily affecting efficiency of the circuit. The foregoing circuits achieve this goal.

Figure 8:
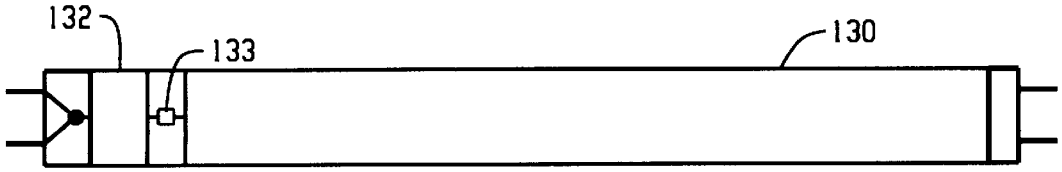
FIG. 8 shows an amplitude modulation circuit integrated into a lamp.
Figure 9:
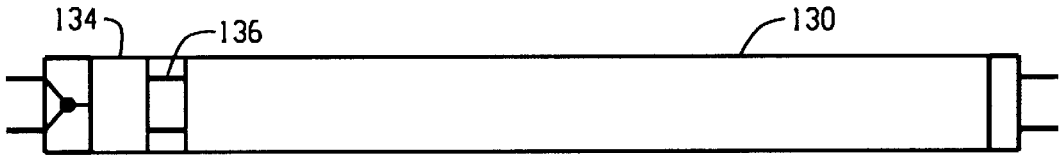
FIG. 9 sets forth an amplitude modulation circuit as a module connected to a lamp.
Figure 10:
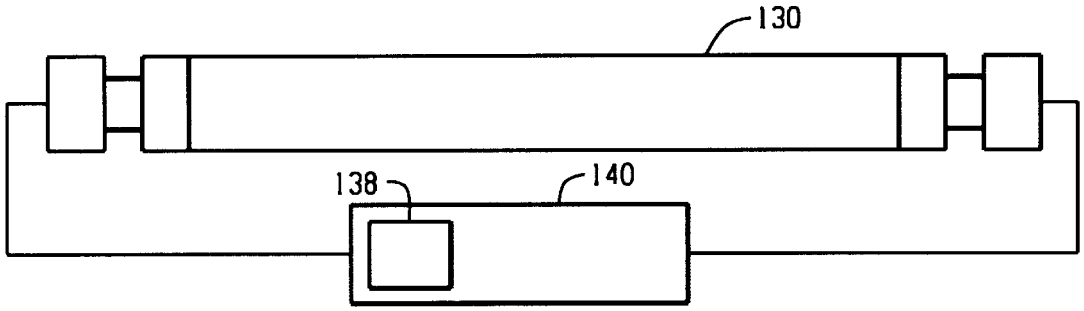
FIG. 10 depicts an amplitude modulation circuit inserted within a ballast.

Turning to FIG. 8, illustrated is a lamp 130 having an amplitude modulation circuit module 132 incorporating the design of the forgoing embodiments, integrated as part to lamp 130 via signal connection point 133. In this design, an end user would buy the lamp without the requirement of any retrofitting of the ballast. FIG. 9 illustrates a lamp 130 where an amplitude modulation circuit module 134 is plugged into lamp 130 at connection prongs 136. FIG. 10 depicts a design where the amplitude modulation circuit 138 is integrated within a ballast 140. By this design, and as previously mentioned, the requirement of a power source within the amplitude modulation circuit 138.

Figure 11:
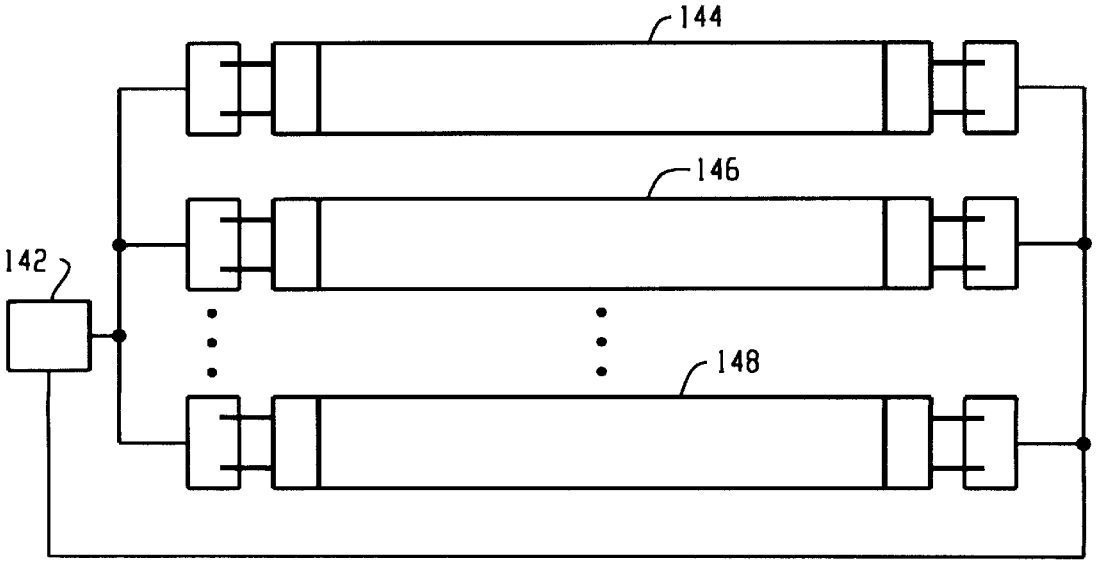
FIG. 11 illustrates a system for operating a plurality of lamps with a single amplitude modulation circuit.

FIG. 11, illustrates a system having an amplitude modulation circuit 140 integrated at a commonly shared inverter or ballast 142 used to power a multiple number of lamps 144, 146, 148. By this design, a single amplitude modulation circuit 140 may be used to remove visual striations from multiple lamps.

As previously noted, while the present invention may be implemented in numerous forms. In the forgoing embodiments, component designations and/or values for the circuits of FIGS. 6 and 7 would include:

Transformer Inductor 62 (2 coupled 1.0 inductors) . . . 100 uH; 1 mH

Capacitor 66 . . . 22 uF

Diodes 72–76 each . . . D1N4148

Zener Diode 78 . . . 5 volts, D1N4740

Resistor 84 . . . 100 K

Schmidt Trigger 90 . . . National Semi CD40106

Capacitor 91 . . . 100 mF

Flip-Flop 94 . . . National Semi CD4013

Transistor 98 . . . IRF510

Diode Bridge 102–108 each . . . D1N4148

Capacitor 118 . . . 22 mF

Transistors 114, 116 . . . Fairchild 6303N

It is to be appreciated additional balancing components may also be added to the circuits of FIGS. 6 and 7. Additionally, while a variety of lamps may be used, for the values presented, the present lamps would operate on a power supply of line 120/277 Vac at 60 Hertz cycle where the lamps may be a gas discharge lamp such as rare gas filled T8 linear fluorescent.

Although the present invention is described primarily in connection with fluorescent lamps, the circuit herein described may be used to control any type of gas discharge lamp. Since certain changes may be made in the above-described circuit without departing from the scope of the invention herein involved, it is intended that all matter contained in the above description or shown in the accompanying drawings shall be interpreted in an illustrative and not a limiting sense.

What is claimed is:

1. A lighting system powered by a system power source, the lighting system comprising:

a ballast in operative connection with the system power source, the ballast designed to generate a lamp input signal;

a lamp input line operatively connected to receive the lamp input signal;

a gas discharge lamp in operative connection to the lamp input line to receive the lamp input signal; and an amplitude modulation circuit in operative connection to the lamp input line, the amplitude modulation circuit configured to alter peak values of the lamp input signal by injection of a periodic amplitude modulation signal prior to the lamp input signal, being received by the gas discharge lamp, wherein the periodic amplitude modulation of the lamp input signal eliminates visual striations in the lamp.

2. The system according to claim 1 wherein the amplitude modulation circuit includes:

amplitude modulation electronics; and a switching mechanism operationally controlled by the amplitude modulation electronics.

3. The system according to claim 1 further including at least a second gas discharge lamp powered by the ballast, wherein the amplitude modulation circuit is integrated within the ballast and which periodically modulates the input lamp signal of the gas discharge lamp and the at least second gas discharge lamp.

4. The system according to claim 1 wherein the amplitude modulation circuit includes:

an amplitude modulation power source which generates a voltage from a current in the lamp input line;

amplitude modulation electronics powered by the amplitude modulation power source; and a switching mechanism operationally controlled by the amplitude modulation electronics.

5. The system according to claim 1 wherein the amplitude modulation circuit is integrated within the lamp.

6. The system according to claim 1 wherein the amplitude modulation circuit is a module connected between the ballast and the lamp.

7. The system according to claim 1 whereby the amplitude modulation circuit is integrated within the ballast.

8. The system according to claim 1 wherein the amplitude modulation circuit decreases the efficiency of the system by approximately ½% or less when configured for use as a module connected to the gas discharge lamp or integrated into the gas discharge lamp.

9. The system according to claim 1 wherein the amplitude modulation circuit decreases the efficiency of the system by less than approximately ½%.

10. The system according to claim 1 wherein the injection of the amplitude modulation signal modulates the current values of the lamp input signal and leaves the frequency unchanged.

11. A method of supplying signals to a gas discharge lamp in a lamp lighting system which eliminates visual striations from appearing in the lamp, the method comprising:

generating a lamp input signal by a ballast;

supplying the lamp input signal to the gas discharge lamp, via a lamp input line;

interjecting a periodic amplitude modulation signal from an amplitude modulation circuit into the lamp input signal, wherein peak values of the lamp input signal are altered in order to remove the visual striations.

12. The method according to claim 11 wherein interjecting the periodic amplitude modulation signal acts to alter repeating resonance signals of the lamp input signal.

13. The method according to claim 11 wherein injection of the amplitude modulation signal modulates the current values of the lamp input signal and leaves the frequency unchanged.

14. A lighting system powered by a system power source, the lighting system comprising:

a ballast in operative connection with the system power source, the ballast designed to generate a lamp input signal;

a lamp input line operatively connected to receive the lamp input signal;

a gas discharge lamp in operative connection to the lamp input line to receive the lamp input signal; and an amplitude modulation circuit in operative connection to the lamp input line, the amplitude modulation circuit configured to periodically modulate amplitude of the lamp input signal by injection of an amplitude modulation signal prior to the lamp input signal being received by the gas discharge lamp, wherein the amplitude modulation circuit decreases the efficiency of the system by less than approximately ½%, and wherein the periodic amplitude modulation of the lamp input signal eliminates visual striations in the lamp.

15. The system according to claim 14 wherein the amplitude modulation circuit includes:

amplitude modulation electronics; and a switching mechanism operationally controlled by the amplitude modulation electronics.

16. The system according to claim 14 wherein the injection of the amplitude modulation signal modulates the current values of the lamp input signal and leaves the frequency unchanged.

17. A lighting system powered by a system power source, the lighting system comprising:

a ballast in operative connection with the system power source, the ballast designed to generate a lamp input signal;

a lamp input line operatively connected to receive the lamp input signal;

a gas discharge lamp in operative connection to the lamp input line to receive the lamp input signal; and an amplitude modulation circuit in operative connection to the lamp input line, the amplitude modulation circuit configured to periodically modulate amplitude of the lamp input signal by injection of an amplitude modulation signal prior to the lamp input signal being received by the gas discharge lamp, wherein the injection of the amplitude modulation signal modulates the current values of the lamp input signal and leaves the frequency unchanged, and wherein the periodic amplitude modulation of the lamp input signal eliminates visual striations in the lamp.

18. The system according to claim 17 wherein the amplitude modulation circuit includes:

amplitude modulation electronics; and a switching mechanism operationally controlled by the amplitude modulation electronics.

19. The system according to claim 17 wherein the amplitude modulation circuit decreases the efficiency of the system by less than approximately ½%.

* * * * *